United States Patent [19]

Rhoads

[11] Patent Number: 4,574,949

[45] Date of Patent: Mar. 11, 1986

[54] POLYMER COMPOSITION AND ARTICLES PREPARED FROM SAME

[75] Inventor: Roger R. Rhoads, Toledo, Ohio

[73] Assignee: Owens-Illinois, Inc., Toledo, Ohio

[21] Appl. No.: 628,361

[22] Filed: Jul. 6, 1984

[51] Int. Cl.[4] ..... B65D 75/00; B32B 3/10

[52] U.S. Cl. ..... 206/150; 428/131

[58] Field of Search ..... 206/150; 428/131

[56] References Cited

U.S. PATENT DOCUMENTS

| | | | |
|---|---|---|---|
| 3,384,696 | 5/1968 | Makansi | 428/131 |
| 3,387,077 | 6/1968 | Sammons et al. | 428/131 |
| 3,916,051 | 10/1975 | Wakeman | 428/131 |
| 4,116,331 | 9/1978 | Curry et al. | 206/150 |
| 4,219,117 | 8/1980 | Weaver et al. | 206/150 |
| 4,434,199 | 2/1984 | Far, Sr. | 428/131 |

*Primary Examiner*—Joseph Man-Fu Moy

*Attorney, Agent, or Firm*—Philip M. Rice

[57] ABSTRACT

A polymer composition and articles fabricated therefrom is disclosed wherein the polymer composition comprises a low density polyethylene resin containing very small amounts of erucamide and oleamide. The composition is useful for forming article carriers and particularly useful for forming carriers for groups of metal cans which cans are subject to rotation in the carrier during use without significant injury to the carrier.

2 Claims, 1 Drawing Figure

POLYMER COMPOSITION AND ARTICLES PREPARED FROM SAME

BACKGROUND OF THE INVENTION

The present invention relates to article carriers and particularly to article carriers suitable for holding a group of metal cans and to the polymer composition from which the articles are formed.

In the past, a wide variety of carriers have been used to contain metal cans in six packs and other arrangements. Usually six packs of beer and soft drinks are packaged in paper wraparound carriers or in band-type unitary flexible plastic web carriers. Such plastic carriers are typically fabricated from low density polyethylene resin cut from a continuous plastic extruded sheet. The carriers have a unitary web main structure which has a plurality of can supporting and engaging loops or so-called aperture portions.

Usually the cans are grouped in a six pack arrangement and subsequently, the plastic carrier is stretched, placed over the cans and released so the stretched loops contract and securely engage the cans. If the loop portions do not engage the cans firmly enough, the heavy filled cans may release from the package. Even if the loop portions are properly tensioned after installation when the cans are rotated within the carrier during production, shipping, display in the retail outlet and during use, the plastic of the loops is subject to failure. The failure occurs usually by (a) the metal of the can sidewall adhering strongly to the plastic of the carrier by spontaneous adhesion and as the can rotates completely tearing the plastic loop, thereby releasing the can from the package, or (b) the metal sidewall of the can adheres to the plastic of the loop upon rotation of the can for long enough to stretch the plastic out of its normal shape, known as necking down of the plastic, and thus opens the can engaging loop to the point where the can may fall from the package.

Both of these failure modes, complete breakage of the loop or extensive stretching causing release, have caused a severe problem in the market place since premature release of the cans from the carrier is a commercially unacceptable situation. The problem is particularly severe when cans are oriented during display to allow for maximum presentation of the product identifying label or so-called billboard. When the sales staff in the store rotates the cans on the shelf to give maximum billboard the carriers are frequently torn or stretched to the point of can release and thus cause a significant amount of product return to the canner.

The problem is worsened when cans are overfilled and water, beer or soft drinks containing sugar contacts the cans and carrier. The sticky fluids dry under hot temperatures during shipping and storage causing the metal cans to adhere even more strongly to the plastic. This makes carrier damage even more probable during can rotation.

One approach to solving this problem has been to use a chilled matte or so-called roughened surfaced chrome roller to emboss surface irregularities onto the carriers after hot melt extrusion of the sheet which will form the carrier blanks. This lessens the actual surface-to-surface contact between the metal can wall and the plastic surface of the carrier. This lessens the adhesion and thus the probability of carrier damage and the corresponding premature release of heavy filled cans from the carrier. However, adding an embossing roller not only adds an expensive extra production step but has been found to slow production since the hot newly extruded sheet which will form the carrier blanks material tends to stick to the chilled roller excessively and significantly lower production line speeds.

Also, since some can styles do not utilize the matte finish carriers, many producers must have two inventories of carriers, one embossed and one plain. This is uneconomical from an inventory control standpoint.

Another approach to solve the problem of carrier damage has been to intimately blend low density polyethylene resin with relatively large amounts of erucamide and with an antiblocking agent like finely divided silica. This composition, while including an antiblocking agent and the long chain fatty acid amide namely erucamide for lubricity, has experienced problems in that after the composition is blended and extruded into sheetstock from which carriers are formed, a long storage time is necessary before the carriers can be die cut. The polyethylene-erucamide material has been found to stick to forming equipment if the extruded film is die cut within about a 24 hour period post extrusion. This is a significant disadvantage causing expense in delayed use during storage awaiting the proper aging of the composition.

Another approach to solve the problem has been to intimately blend low density polyethylene resin with relatively large amounts of oleamide, another long chain fatty acid amide. This composition using oleamide alone not only does not solve the carrier-can sticking problem, it has caused significant amounts of wax build-up on presses, feed rollers and applicating equipment.

Accordingly, there exists a need in the art for a composition of matter which can be formed into carriers, installed with conventional equipment and accept a variety of can designs and surface finishes and resist carrier degradation during can rotating or so-called can facing. The composition should also be useful for forming carriers without equipment fouling immediately after hot melt extrusion into sheetstock.

SUMMARY OF THE INVENTION

The present invention comprises a low density polyethylene resin based material which can be economically formed into can carriers, as well as other article carriers, using conventional production and installation equipment. The material is suited to forming carriers shortly after being extruded from the melt without curing and does not foul production or applicating machinery with a residue.

The composition includes a base material of low density polyethylene resin into which is intimately blended from between 200 and 1500 parts per million erucamide and from between 50 and 500 parts per million oleamide based upon the weight of the low density polyethylene.

The composition can be formed into carriers for cans and other articles. The composition can effectually retain cans, allow their rotation, or so-called facing, within the carrier during production and display and not suffer a high rate of failure compared to conventional carriers.

BRIEF DESCRIPTION OF THE DRAWINGS

The details of the invention will be described in the accompanying specification in view of the drawing, in which.

DESCRIPTION OF THE INVENTION

Figure 1:
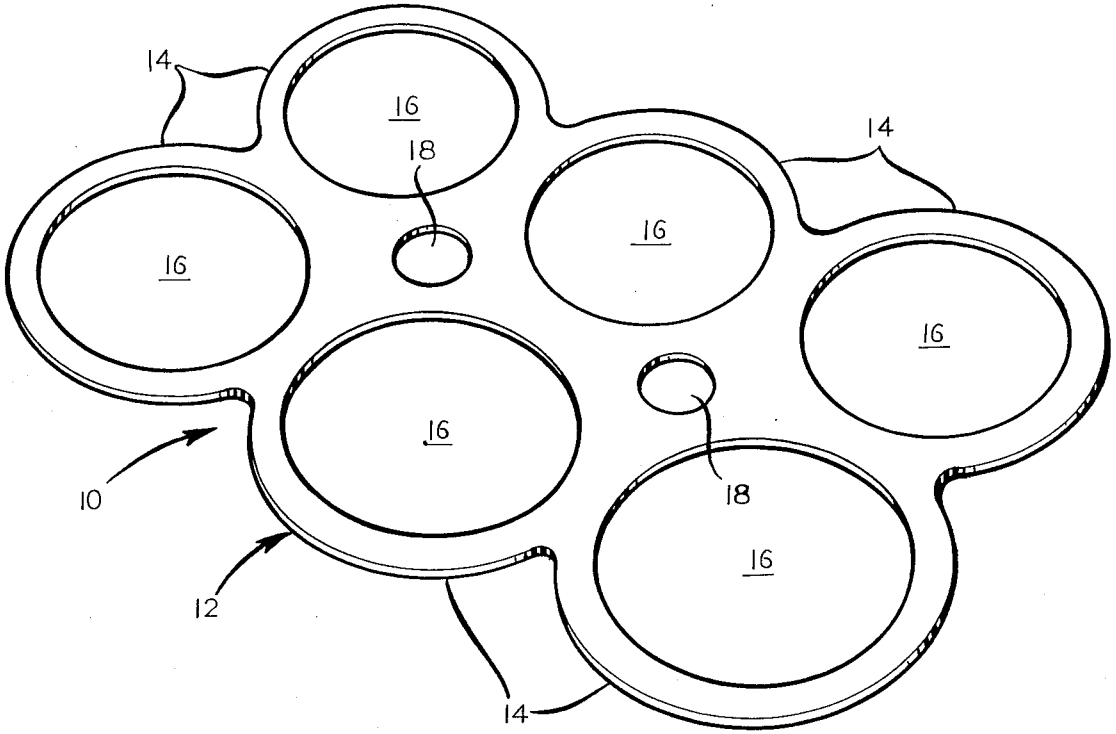
FIG. 1 is a perspective view of a flexible article carrier according to the present invention suited to contain cans.

The present invention comprises a composition of matter, the process for the production thereof and article carriers, particularly flexible can carriers, fabricated from the composition of matter.

The composition of matter comprises a low density polyethylene resin intimately admixed with an amount of erucamide between 200 and 1500 parts per million and an amount of oleamide between 50 and 500 parts per million.

As defined herein "low density polyethylene" is defined as a homopolymer of ethylene having a density of between 0.910 grams/cc and 0.935 grams/cc.

Additionally, the blended low density polyethylene resin based composition may include an amount of finely divided silica antiblocking agent as is well known in the plastic carrier art. An amount of silica of about 800 parts per million is conventional and acceptable for use with the present composition.

The preferred composition according to the present invention is a low density polyethylene resin containing about 600 parts per million erucamide and about 200 parts per million oleamide. Also, where antiblocking characteristics are important, an amount of finely divided silica in the amount of 800 parts per million may be added.

The preferred process for compounding the composition according to the present invention comprises weighing out a prescribed amount of both erucamide and oleamide and adding it to a preweighed amount of low density polyethylene, tumble, blending until well dispersed, extruding through a strand die and repelletize as is well known to one skilled in the art.

After compounding, the composition is hot melt extruded into a film and carrier blanks are formed therein by conventional techniques.

A flexible carrier 10 according to the present invention is shown in FIG. 1 and includes a flexible unitary web portion 12 which includes a plurality of can supporting and engaging loop portions 14 which form the circular can accepting apertures 16. Typically, the flexible article carrier 10 includes a pair of hand grip portions 18. Typically, such carriers are about 16 mils thick.

The preferred erucamide is supplied by Witco Chemical Co. and has the following physical properties: Tm=76°-86° C., 95% min. amide by IR analysis, iodine value:70-80, marketed under the tradename Kemamide E.

The preferred oleamide is supplied by Witco Chemical Co. and has the following physical properties: Tm=68°-78° C., 95% min. amide by IR analysis, iodine value: 72-90, marketed under the tradename Kemamide U.

Occasionally, a white pigment colorant will be added for purely cosmetic effect to produce white carriers. When colorants are added in conventional amounts, I have discovered that the amount of erucamide should be in the upper part of the concentration range defined above, for example 900 parts per million. Normally, for uncolored or so-called natural color carriers, an amount of erucamide of 500-600 parts per million is preferred to accept most can designs, metals and surface finishes.

Also, I prefer to add amounts of oleamide on the order of 250 parts per million to most carrier compositions for good utility with most can designs, metals and surface finishes.

Thus, for natural color carriers of non-colorant containing resin, I prefer an amount of about 600 parts per million erucamide and about 250 parts per million oleamide. For carrier compositions containing colorants, I prefer about 900 parts per million erucamide and about 250 parts per million oleamide.

In order to demonstrate the superior results achieved when employing the composition and carrier prepared according to the present invention, a variety of different filled cans containing soft drinks were purchased in the market place. As indicated above, each can manufacturer fabricates cans from different metals, using different can drawing techniques as well as different lubricants, surface finishes, paints, inks and lacquers. This gives each can when finished and filled with beverage different surface characteristics which effect the interaction between can and carrier. Therefore, to demonstrate the wide utility of the present invention a large group of different cans, from different manufacturers, in different geographic locations, were acquired and tested.

To conduct the test, clean cans which were filled with beverage and sealed at the cannery were purchased at the geographic location as indicated. Six cans were grouped together and a carrier like the one illustrated in FIG. 1 and generally described as a commercially available standard 2209 beverage can carrier was installed using standard techniques.

The six packs with the carrier in place were next inverted and about two ounces of either water or a 15 percent solution of a carbonated cola soft drink was poured between the cans to thoroughly wet the carrier-can interface. This promotes adhesion between the can sidewall and the carrier and simulates the overfill situation commonly experienced in commercial production can lines. Next, the six packs are stored at 100° F. for 48 hours, at about 30 percent relative humidity, to further promote adhesion. Next, a 24 hour cool down period was allowed for the cans to cool to room temperature. Next, the cans were twisted with a standard commercially available torque tester to demonstrate the improved ease of can rotation, i.e., lower twisting torque required to begin can rotation, without necking down of the carrier or total tearing of the container loop portion.

Table I illustrates the results when cans in carriers were exposed to 15 percent carbonated cola beverages while Table II represents cans in carriers where the cans in carriers are exposed to water and then heated to promote adhesion.

The standard carrier type as set forth in the Tables I and II is one conventional in the industry and composed of Union Carbide DHDG-4163 low density polyethylene containing about 450 parts per million oleamide and about 800 parts per million finely-divided silica antiblocking agent, without a colorant.

The standard matte carrier type as set forth in the Tables I and II is a carrier composed of the same material as set forth above for the standard carrier but having a matte or roughened finish as is conventional in the industry. The new carrier according to the present invention as set forth in the Tables I and II is defined as LDPE-E-O carrier, representing the present carrier fabricated from low density polyethylene, erucamide and oleamide in concentrations of 600 and 200 parts per million, respectively, without any colorant.

The experimental results are as follows:

TABLE I

| Can Number | Can Material | Point of Purchase | Torque (in inch-pounds) Standard Carrier | Standard Matte Carrier | LDPE-E-O Carrier |
|---|---|---|---|---|---|
| 1 | Aluminum | Lansing, MI | 19* | 10 | 9 |
| 2 | Aluminum | Clinton, MI | 18 | 16 | 8 |
| 3 | Steel | Ft. Wayne, IN | 17 | 10 | 7 |
| 4 | Aluminum | Ft. Wayne, IN | 17 | 10 | 9 |
| 5 | Aluminum | Salt Lake City, UT | 25* | 10 | 8 |
| 6 | Aluminum | Clinton, MS | 20* | 15 | 9 |
| 7 | Aluminum | Clinton, MS | 19* | 14 | 5 |
| 8 | Aluminum | Clinton, MS | 26 | 13 | 9 |
| 9 | Steel | Miami, FL | 17 | 16 | 7 |
| 10 | Aluminum | Dallas, TX | 23* | (Unavailable) | 6 |
| 11 | Aluminum | Salt Lake City, UT | (Unavailable) | 19 | 9 |
| 12 | Aluminum | Colliers-ville, TN | 25* | 20 | 6 |
| 13 | Aluminum | Tampa, FL | 22* | 17 | 10 |

(*indicates two or more loops necked down or completely separated)

TABLE II

| Can Number | Can Material | Point of Purchase | Torque (in inch-pounds) Standard Carrier | Standard Matte Carrier | LDPE-E-O Carrier |
|---|---|---|---|---|---|
| 1 | Aluminum | Lansing, MI | 16* | 9 | 8 |
| 2 | Aluminum | Clinton, MS | 23* | 13 | 9 |
| 3 | Aluminum | Clinton, MS | 23* | 12 | 8 |
| 4 | Steel | Ft. Wayne, IN | 14 | 9 | 7 |
| 5 | Aluminum | Ft. Wayne, IN | 13 | 7 | 7 |
| 6 | Aluminum | Clinton, MS | 20 | 11 | 9 |
| 7 | Aluminum | Clinton, MS | 23* | 11 | 7 |
| 8 | Aluminum | Clinton, MS | 22* | 12 | 9 |
| 9 | Steel | Miami, FL | 15 | (unavailable) | 5 |
| 10 | Aluminum | Dallas, TX | 24* | (unavailable) | 9 |
| 11 | Aluminum | Colliers-ville, TN | 16 | 14 | 6 |

(* indicates two or more loops necked down or completely separated)

The results set forth in Tables I and II clearly illustrate the superior character of the carriers according to the present invention. Notice the uniformly lower torque required to rotate or face cans in carriers fabricated from the present inventive as compared to either standard or improved type standard matte carriers. Also note a significant number of carrier failures of the standard carriers. Clearly different design cans, having different materials (aluminum or steel), having different print compositions and different surface treatments show substantial variance in can rotation torque necessary to rotate the can. However, uniformly, regardless of can metal, shape, design, surface print and treatment characteristics, the present invention lowers rotation torque, while not allowing can release to carrier loop neck down or tearing. Yet, cans do not spontaneously slip from the present carriers. So, carriers according to the present invention hold cans firmly enough for shipment and use under normal circumstances but not too tightly to prevent can facing in retail outlets so as to maximize display of the cans.

Notice that from the examples set forth in Table I, the average difference between the standard carriers and the standard matte carriers is about −6.7 inch-pounds. The average difference between the carriers of the present invention and the standard carriers is about −12.9 inch-pounds. The average difference between the carriers of the present invention and the standard matte carriers is about −6.2 inch-pounds. This illustrates that the carriers of the present inventions are superior to the standard matte carriers and even more superior to the conventional standard carriers when contaminated with sugar-containing high adhesion carbonated soft drinks.

The superior results of the present invention are also apparent from the results of Table II as relate to wash water contaminated can carriers. The matte finish conventional carriers outperform the standard carriers by about −8.0 inch-pounds on average. The present carriers according to the invention outperforms the standard carriers by about −11.4 inch-pounds on average and the matte finish carrier by about −3.0 inch-pounds.

To illustrate the superior results achieved when employing the composition and carrier of the present invention, a variety of different concentration ranges of the present composition containing varied amounts of erucamide and oleamide were formulated and compared with erucamide alone and oleamide alone compositions.

To conduct the test, clean cans were placed in carriers and exposed to water or dilute carbonated cola beverage solutions as described above for the tests of Table I and II. Also, the torque test was conducted as set forth above.

Table III sets forth the comparative experimental results as follows:

TABLE III

| Erucamide Content (parts per million) | Oleamide Content (parts per million) | Torque (in-inch pounds) water Wash | Carbonated Cola Beverage Wash | Difference from Std. Carrier Water | Cola |
|---|---|---|---|---|---|
| 215 | — | 12 | 16 | 7.8 | 6.3 |
| 350 | — | 9 | 14 | 10.5 | 8.7 |
| 480 | — | — | 6 | — | 12.5 |
| 560 | — | 7 | 9 | 13.3 | 11.0 |
| 600 | — | 6 | 10 | 13.8 | 12.0 |
| 865 | — | 6 | 9 | 14.0 | 13.3 |
| — | 230 | 12–18 | 22* | STD | STD |
| — | 480 | 12 | 22* | 8.0 | 2.7 |
| — | 510 | 12 | 19* | 7.8 | 3.0 |
| — | 535 | 16 | 22* | 7.3 | (0.3) |
| 290 | 90 | 10 | 16 | 10.5 | 4.7 |
| 375 | 225 | 9 | 15 | 10.5 | 7.7 |
| 590 | 240 | (8) | (8) | (8) | (12) |
| 700 | 250 | 8 | 14 | 12.3 | 8.7 |
| 380 | 270 | 7 | 8 | 7.6 | 9.6 |
| 380 | 300 | — | 8 | — | 10.5 |
| 600 | 300 | 8 | 8 | 12.0 | 14.7 |
| 440 | 350 | 7 | 9 | 7.0 | 8.9 |
| 500 | 400 | 6 | 9 | 4.8 | 7.2 |
| 530 | 560 | 9 | 14 | 11.3 | 8.0 |

( ) represents single six-pack used in test
*indicates two or more loops necked down or completely separated The first column shows the parts per million concentration of erucamide, the second column shows the parts per million oleamide concentration, both in the low density polyethylene as defined above, the composition having no colorant added.

The third column sets forth the torque of rotation results for carriers subjected to water wash and heat treating as set forth above while column four sets forth the torque of rotation results for carriers subjected to a wash with 15 percent carbonated cola beverage.

The fifth and sixth columns set forth the net torque of rotation difference between carriers of identical polyethylene chemical composition but having no erucamide or oleamide with column five being a water wash like column three and column six being carbonated cola beverage wash like column four.

Note that as described above, oleamide alone shows a significant number of carrier failure upon heat treating with the beverage and as described above caused wax build-up on operating equipment.

Carriers of erucamide alone as described above must be aged for a significant time prior to use or the carrier blanks stick to the operating equipment which is disadvantageous.

As Table III illustrates when the compositions according to the present invention are employed not only can the material be punched and installed on cans rapidly but it shows consistently superior results to carriers with either oleamide alone or erucamide alone.

I claim:

1. A composition of matter comprising:

a low density polyethylene resin admixed with, (1) an amount of erucamide between 200 and 1500 parts per million based on the weight of the low density polyethylene resin, and (2) an amount of oleamide between 50 and 500 parts per million based on the weight of the low density polyethylene resin.

2. A flexible article carrier suited to carry a plurality of cans comprising:

a unitary flexible plastic web portion; and a plurality of can supporting loop portions disposed within said web portion;

wherein said flexible article carrier is comprised of a low density polyethylene resin containing erucamide in an amount between 200 and 1500 parts per million based on the weight of the low density polyethylene resin, and oleamide in an amount between 50 and 500 parts per million based on the weight of the low density polyethylene resin.

* * * * *